US008413665B2

(12) United States Patent
Estrella Gomez

(10) Patent No.: US 8,413,665 B2
(45) **Date of Patent: *Apr. 9, 2013**

(54) SMOKING KIT FOR CUSTOMIZING A TOBACCO PRODUCT, METHOD FOR PURVEYING A TOBACCO SMOKING PRODUCT, SMOKING PRODUCT AND METHOD OF PROVIDING A SMOKING PRODUCT

(76) Inventor: Remberto Andres Estrella Gomez, Santiago (DO)

( * ) Notice: Subject to any disclaimer, the term of this patent is extended or adjusted under 35 U.S.C. 154(b) by 7 days.

This patent is subject to a terminal disclaimer.

(21) Appl. No.: 12/552,050

(22) Filed: Sep. 1, 2009

(65) Prior Publication Data

US 2009/0314301 A1 Dec. 24, 2009

Related U.S. Application Data

(62) Division of application No. 10/957,462, filed on Oct. 1, 2004, now Pat. No. 7,604, 008.

(60) Provisional application No. 60/507,951, filed on Oct. 3, 2003.

(51) Int. Cl.
*A24F 11/00* (2006.01)

(52) U.S. Cl.
USPC ..... 131/328

(58) Field of Classification Search ..... 131/360, 131/365, 328
See application file for complete search history.

(56) References Cited

U.S. PATENT DOCUMENTS

| | | | | |
|---|---|---|---|---|
| 191,501 | A | 5/1877 | Willis | |
| 200,889 | A | 3/1878 | Bishop | |
| 236,510 | A | 1/1881 | Pacholder | |
| 304,582 | A | 9/1884 | Thoss | |
| 389,975 | A | 9/1888 | Riedel | |
| 657,403 | A | 9/1900 | Brul | |
| 663,073 | A | 12/1900 | Coughtry | |
| 725,671 | A | 4/1903 | Butler | |
| 1,104,779 | A | 7/1914 | Cooley | |
| 1,223,362 | A | 4/1917 | Bock | |
| 3,385,302 | A * | 5/1968 | Wattenford | 131/360 |
| 3,397,700 | A | 8/1968 | Harlow et al. | |
| 4,452,257 | A | 6/1984 | Cartwright et al. | |
| 4,505,282 | A | 3/1985 | Cogbill et al. | |
| 4,687,008 | A | 8/1987 | Houck, Jr. et al. | |
| 4,733,995 | A | 3/1988 | Aebi | |
| 4,832,057 | A * | 5/1989 | Bale et al. | 131/73 |

(Continued)

OTHER PUBLICATIONS

"How to Smoke a Cigar", www.howtosmokeacigar.com, 2011.

*Primary Examiner* — Richard Crispino
*Assistant Examiner* — Dionne W Mayes
(74) *Attorney, Agent, or Firm* — Laurence A. Greenberg; Werner H. Stemer; Ralph E. Locher

(57) ABSTRACT

Smoking kit and techniques for purveying a tobacco product are provided. The kit includes at least one pre-finished tobacco product. The kit further includes at least one wrapping sheet supported by the pre-finished product in a predetermined shape. The wrapping sheet may be configured to exhibit a perceptible olfacto-gustatory characteristic. A consumer can optionally roll the wrapping sheet around the pre-finished product to create a consumer-customized smoking product influenced by the olfacto-gustatory characteristic of the wrapping sheet. Another option may be for the consumer to smoke the pre-finished tobacco product as is.

11 Claims, 2 Drawing Sheets

U.S. PATENT DOCUMENTS 5,147,463 A 9/1992 Eilerman et al.
5,167,241 A 12/1992 Ruppert et al.
5,458,107 A 10/1995 Balogh et al.
5,615,694 A 4/1997 Battard et al.
5,645,089 A 7/1997 Burger et al.
5,657,773 A * 8/1997 George ..... 131/365
5,749,378 A 5/1998 Ruppert et al.
5,762,074 A 6/1998 Garner
5,782,246 A 7/1998 Axelrod
6,053,175 A 4/2000 D'Angelo
6,164,443 A * 12/2000 Mitchell et al. ..... 206/242
6,321,755 B1 11/2001 Sinclair, Jr.
6,357,448 B1 3/2002 Sinclair, Jr.
6,526,986 B1 3/2003 Sinclair, Jr.
6,742,525 B2 * 6/2004 Sinclair, Jr. ..... 131/365
7,604,008 B2 * 10/2009 Gomez ..... 131/365
2002/0112450 A1 8/2002 Roscoe
2003/0119644 A1 6/2003 Draghetti et al.
2003/0217757 A1 * 11/2003 Edelmann ..... 131/360
2007/0095357 A1 5/2007 Besso et al.

* cited by examiner

SMOKING KIT FOR CUSTOMIZING A TOBACCO PRODUCT, METHOD FOR PURVEYING A TOBACCO SMOKING PRODUCT, SMOKING PRODUCT AND METHOD OF PROVIDING A SMOKING PRODUCT

CROSS-REFERENCE TO RELATED APPLICATION

This application is a division of application Ser. No. 10/957,462, filed Oct. 1, 2004; the application also claims priority, under 35 U.S.C. §119(e), of provisional application Ser. No. 60/507,951, filed Oct. 3, 2003; the prior applications are incorporated herewith by reference in their entirety.

BACKGROUND OF THE INVENTION

Field of the Invention

The present invention generally relates to tobacco products for smoking. More specifically, the present invention relates to a smoking kit and techniques that allow including one or more wrapper sheets designed to affect olfacto-gustatory qualities (e.g., flavor, aroma and/or strength of each) of cigars or cigarettes that are included as part of the smoking kit.

Throughout the history of mankind, people have enjoyed and continue to enjoy tobacco products. The peoples of the pre-Columbian Americas are believed first to have used tobacco. For example, Native Americans cultivated the tobacco plant and smoked it in pipes purportedly for medicinal and ceremonial purposes.

More recently, a good number of consumers of tobacco products, such as cigar or cigarettes, have a desire or fancy for individually customizing aroma, scent, taste and/or strength of a given product. It is generally known for these consumers to wrap their own tobacco products for smoking. This is generally referred to in the art as "wrap-your-own" product for smoking. However, known techniques for wrapping and/or creating a customized tobacco product have been somewhat burdensome and time consuming for the consumer. For example, in the case of a consumer customizing their own cigarettes, the consumer generally has to make a first purchase for acquiring the cigarette wrappers. A second purchase may then be made of a pre-processed filler tobacco of their choice so that the consumer can finally proceed to roll the cigarette wrapper around the tobacco filler. Thus, the consumer is generally burdened with having to make separate purchasing transactions in order to obtain the components for creating a customized smoking product.

Wrapping difficulties can arise because the wrapper may be sold in packages wherein the wrapper is flat, and thus it becomes difficult to roll over the tobacco filler. Moreover, even if the wrapper is pre-rolled in a generally cylindrical shape, it is believed that no prior packaging and/or marketing techniques in the tobacco industry have purveyed such a wrapper component in combination with a pre-finished smoking tobacco product that would optionally allow the consumer to either readily perform a desired customization for the tobacco product, or would allow to enjoy a fine pre-finished product as is.

BRIEF SUMMARY OF THE INVENTION

In view of the foregoing considerations, it is desirable to provide a smoking kit and techniques that would enable a consumer of a smoking tobacco product to readily participate in a final configuration of a cigar or cigarette and, thereby, customize the taste, aroma, flavor, scent and/or strength of the cigar or cigarette to his or her pleasure. This goal should preferably be achieved without having to perform separate purchasing transactions of customizing components or necessitating special instruments and handling of chemical compounds or requiring a superior manual dexterity.

In one aspect, the invention provides a smoking kit comprising at least one pre-finished tobacco product and at least one wrapping sheet. The pre-finished tobacco product is smokable as is and the at least one wrapping sheet supported by the pre-finished tobacco product in a predetermined shape. The wrapping sheet can have at least one perceptible olfacto-gustatory characteristic, and can be unwrapped from the pre-finished tobacco product. Also, the at least one wrapping sheet can be rolled by a consumer around the pre-finished tobacco product to create a consumer-customized product influenced by the olfacto-gustatory characteristic of the wrapping sheet.

In another aspect, the invention provides a method for purveying a tobacco smoking product. The method comprises providing a smoking kit including at least one pre-finished tobacco product which is smokable as is. The pre-finished tobacco product can support the at least one wrapping sheet on the pre-finished tobacco product in a predetermined shape. The wrapping sheet can have at least one perceptible olfacto-gustatory characteristic. Also, the wrapping sheet can be unwrapped from the pre-finished tobacco product and can be adhesively affixed by a consumer around the pre-finished tobacco product to create a consumer-customized smoking product having olfacto-gustatory characteristics influenced by the at least one perceptible olfacto-gustatory characteristic of the wrapping sheet.

Other features which are considered as characteristic for the invention are set forth in the appended claims.

Although the invention is illustrated and described herein as embodied in smoking kit for customizing a tobacco product, method for purveying a tobacco smoking product, smoking product and method of providing a smoking product, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
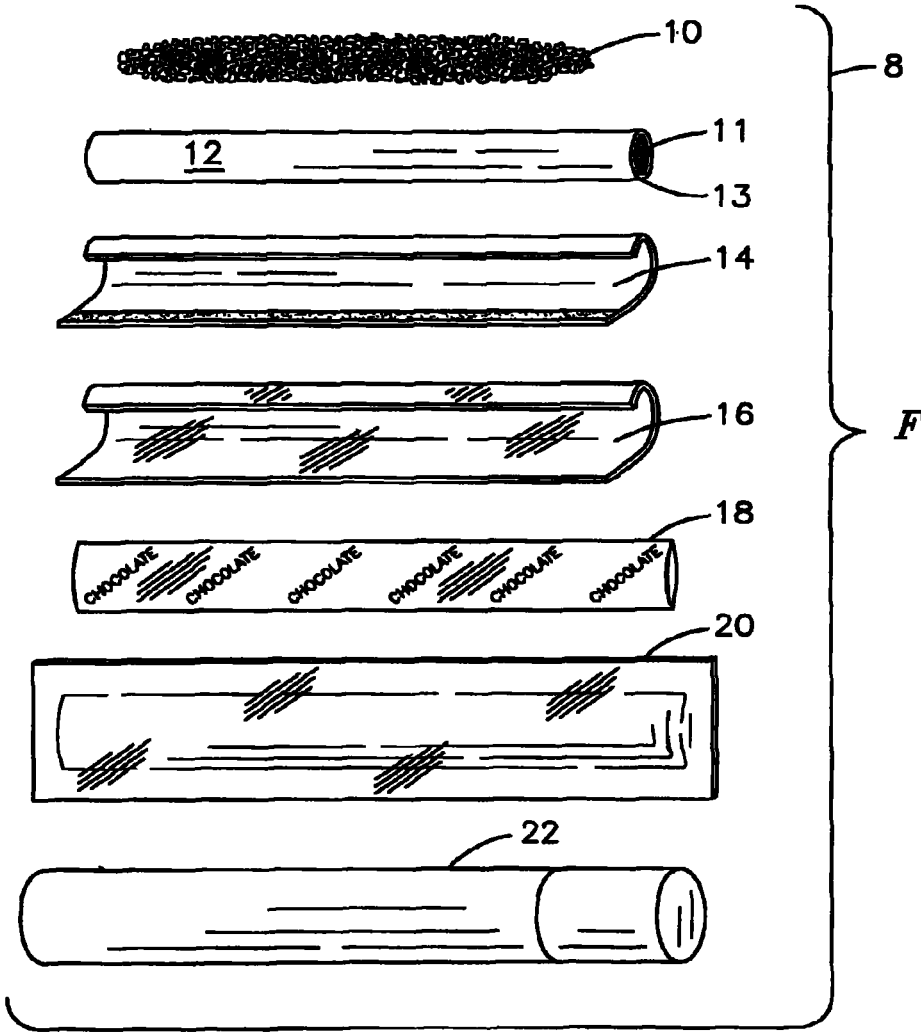
FIG. 1 illustrates in a separated condition exemplary components that in combination make up a tobacco smoking kit embodying aspects of the present invention.

The term "tobacco products" as used herein includes any of various commercially available tobacco products that may be smoked, such as cigarettes and cigars, which generally may (but need not) have a cylindrical-rod shape. For example, a conical shape may be equally feasible for the tobacco product. FIG. 1 illustrates some exemplary constituents that in various forms may comprise a smoking kit 8 embodying aspects of the present invention.

More specifically, FIG. 1 illustrates a bundle of natural tobacco 10 that may have been previously processed as tobacco filler 11 and wrapped in a conventional wrapper 13 to form a pre-finished and fully smokable tobacco product 12. That is, the smoking kit includes one or more pre-finished tobacco products that may be optionally smoked "as is" by the consumer. The kit further includes one or more wrapping sheets 14, each of which may exhibit one or more perceptible olfactory and/or gustatory (referred to herein as olfacto-gustatory) characteristics, such as a respective natural or artificial flavoring and/or scent or may be unscented, as such characteristics may be perceived by the senses of smell and/or taste. That is, at the option of the consumer, one or more wrapping sheets 14 can be rolled onto the pre-finished tobacco product 12 to achieve a desired olfacto-gustatory effect for the customized product. The kit may include an insulator film 16, such as made of polypropylene or any other suitable insulating material, e.g., paper wax.

In one exemplary embodiment, the foregoing constituents of the kit, e.g., one or more pre-finished tobacco products 12, one or more scented or unscented wrapping sheets 14, and one or more insulator films 16, may be pre-packaged in a flexible packaging, such as may comprise a first packaging enclosure 18 that may include a printed indicia of the specific scent of wrapping sheet 14, and a sealed second packaging enclosure 20. By way of example, the packaging enclosures may be made of a suitable flexible polymer, e.g., polypropylene or polyethylene. In another exemplary embodiment, the kit may be packaged in a sealed tubular casing 22 made of a suitable hard plastic or any other suitable relatively lightweight and structurally strong material.

Figure 2:
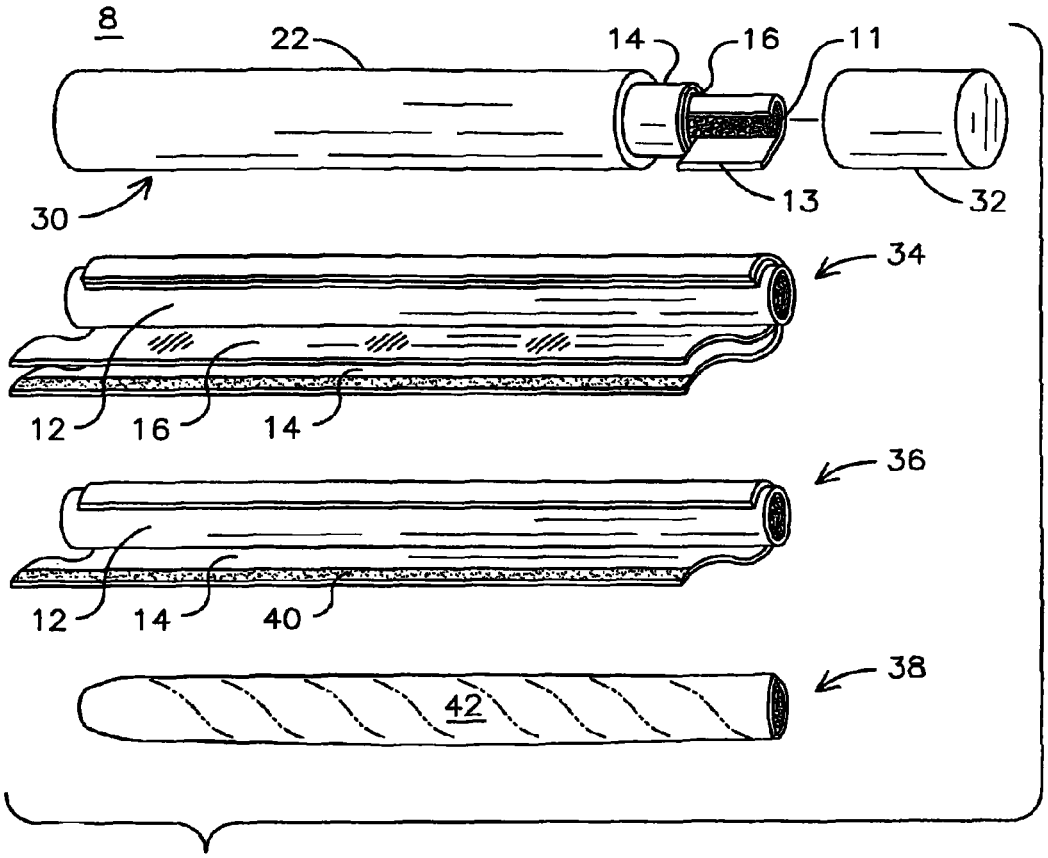
FIG. 2 illustrates a graphical sequence of views for describing exemplary steps in connection with usage of a smoking kit embodying aspects of the present invention.

FIG. 2 illustrates a graphical sequence of views for describing exemplary steps in connection with usage (e.g., assembly) of a smoking kit embodying aspects of the present invention. A first view 30 illustrates a smoking kit 8 as may be exemplarily packaged for delivery to a consumer in hard tubular casing 22.

Upon removal of cap 32 and removal of the contents from tubular casing 22, view 34 illustrates that the pre-finished tobacco product 12 may function as a support structure for maintaining the wrapping sheet 14 in a predetermined shape, such as a generally cylindrical or conical shape. That is, the wrapping sheet 14 may be loosely wrapped (e.g., attached without adhesives) to the pre-finished tobacco product 12. In one exemplary embodiment, insulator film 16 may be sandwiched or interposed between the wrapping sheet 14 (disposed radially outward relative to the insulator film 16), and the pre-finished tobacco product 12 (disposed radially inward relative to the insulator film 16) to, for example, prevent flavorants and/or scents that may be present in the wrapping sheet 14 from leaching out of the wrapping sheet into the adjacent pre-finished smoking product.

At this point, the consumer has the option of unwrapping the insulator film 16 and the scented wrapping sheet 14 from the pre-finished tobacco product 12 and proceeding to directly smoke the pre-finished tobacco product 12, as is. That is, the consumer may choose to smoke without performing any customizing actions. Alternatively, as illustrated in views 36 and 38, the consumer may proceed to remove and discard the insulator 16, and, upon moistening at least one visually or otherwise identifiable (e.g., raised) border 40 of wrapping sheet 14, e.g., pre-treated with a moist-activated adhesive, the consumer may then proceed to roll and adhesively affix the wrapper sheet 14 onto the pre-finished tobacco product 12 to create a consumer-customized tobacco product 42 having a desired olfacto-gustatory effect, at least part of which is contributed by one or more characteristics imparted by the wrapping sheet 14.

Thus, the inventor of the present invention has innovatively recognized a smoking kit that allows the consumer to enjoy a tobacco product that may be optionally configured by the consumer to provide distinct olfacto-gustatory effects or experiences. For example, as stated above, the consumer may choose to smoke the pre-finished product 12 without utilizing a scented wrapper sheet 14. In this case, the consumer will enjoy a fine tobacco product as may be enjoyed in a conventional wrapper.

Alternatively, the consumer may choose to customize the pre-finished product 12 by applying one or more scented wrapper sheets 14 onto the pre-finished product. In one exemplary embodiment, scented wrapper sheet 14 may be made of a homogenized tobacco leaf using tobacco homogenization techniques well understood by those skilled in the art, and would be structurally analogous to sheets used, for example, to make machine-made cigars and cigar wrappings. Alternatively, the scented sheet 14 may be made of a pure tobacco leaf, or may be made of standard wrapping paper as conventionally used for wrapping cigarettes.

Figure 3:
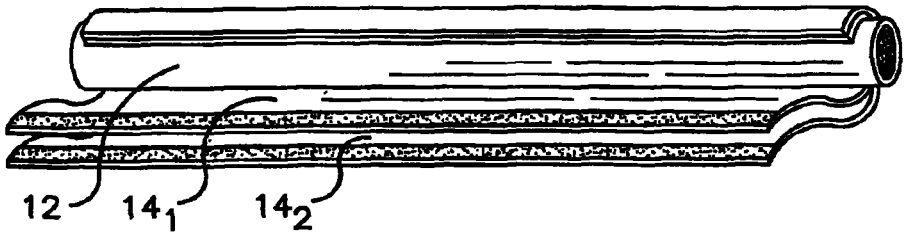
FIG. 3 shows one exemplary embodiment that allows a consumer to wrap multiple scented sheets onto a pre-finished product, and thereby achieves a desired olfacto-gustatory effect.

As set forth below, the olfacto-gustatory experience for the consumer conceptually may be limited just by the imagination and desire of the consumer to experiment with any desired combination of scents and/or flavors. As illustrated in FIG. 3, the consumer has the option of wrapping more than one scented sheet, e.g., scented sheets 14.sub.1 and 14.sub.2, onto the pre-finished product 12.

Any suitable natural or artificial flavorants and/or scents may be employed to flavor the wrapping sheet 14, such as using aromatizing or flavor/scent-modifying techniques well known in the art. Exemplary types of flavorants and/or scents may comprise spice extracts, flower extracts, and fruit extracts. An exemplary list of exemplary flavorants and/or scents may include the following: acacia, rose, cinnamon, jasmine, apple, martini, banana, berries, blackberry, blueberry, butterscotch, champagne, coffee, chocolate, cognac, cosmopolitan, gin and juice, grape, honey, Jamaica rum, kiwi, strawberry, magic stick, mango, mint, passion fruit, peach, pina colada, raspberry, sour apple, strawberry, strawberry margarita, sweet cherry, vanilla, watermelon.

In one aspect of the present invention, the consumer may optionally strengthen a desired flavor or scent for the finished smoking product by wrapping multiple wrapping sheets comprising the same flavorant or scent. In another aspect of the invention, the consumer may mix and match from wrapping sheets comprising a variety (e.g., a potpourri) of flavorants and/or scents to obtain a desired olfacto-gustatory effect due to the combination of such distinct flavorants and/or scents. For example, the desired effect may be to obtain a resultant scent that the consumer may perceive as distinct but generally pleasant to the senses. Conversely, the desired effect may be to obtain a resultant aroma or scent that the consumer may perceive as shocking. For example, the consumer from timeto-time may desire to reduce his or her smoking rate and accordingly that consumer may experiment and create a resultant combination, e.g., mixing coffee and chocolate scents, that may not be perceived as pleasant to the senses.

Figure 4:
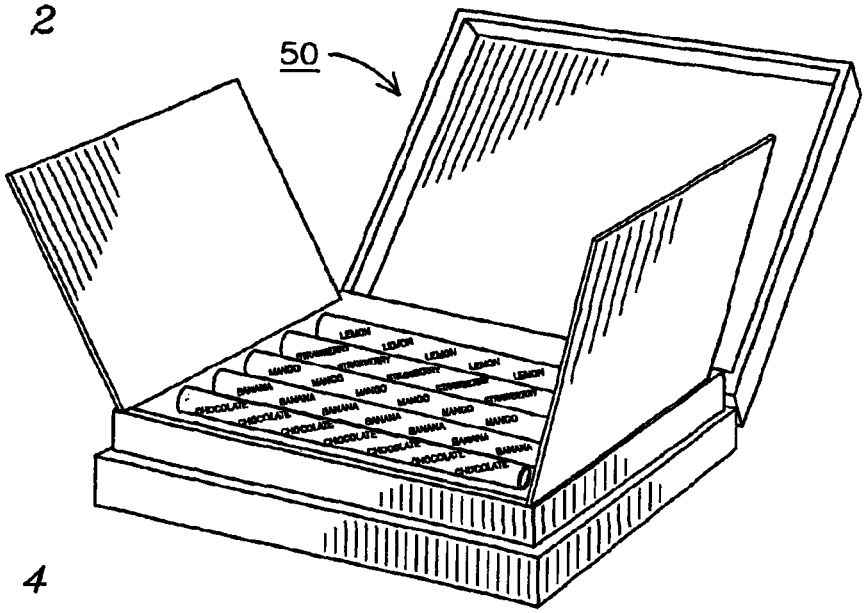
FIG. 4 shows an exemplary packaging that provides a plurality of individually sealed pre-finished smoking products in combination with a plurality of wrapper sheets comprising a variety of scents and/or flavors.

FIG. 4 represents an exemplary packaging that comprises a case 50 including a plurality of pre-finished smoking products in combination with a plurality of wrapper sheets comprising an exemplary variety of scents and/or flavors. The package may comprise individually sealed smoking kits (as described in the context of FIGS. 1 and 2) for conserving the humidity and aroma of the individual tobacco components therein. It will be appreciated that the variety of scents and/or flavors may be personalized to match the desires of a given consumer. Thus, the scents and/or flavors shown in FIG. 4 are just intended to illustrate one example of a possible potpourri of scents and/or flavors. The case may include labeling information (e.g., computer-readable information using a barcode and/or human-readable information such as in the form of a natural language) that may conveniently specify various kit details, such as the flavor of the product, a branding for the kit, the place of production, the production date, and any information intended for the smokers that the applicable laws or regulations of a destination country of the smoking kit may require. Moreover, each individually sealed smoking kit may include suitable indicia (e.g., lettering) of the specific scent so that the consumer can quickly select any desired scent from the potpourri of scents and/or flavors that may be included in the case 50.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

The invention claimed is:

1. A method for purveying a tobacco smoking product, the method comprising the following steps:

providing a smoking kit, the smoking kit including at least one pre-finished tobacco product, the pre-finished tobacco product being smokable by a person by mouth as is;

providing at least one wrapping sheet being smokable by a person by mouth and configured to be loosely wrapped around the pre-finished tobacco product in a predetermined shape with no adhesive between the at least one smokable wrapping sheet and the pre-finished tobacco product, the at least one smokable wrapping sheet having at least one perceptible olfacto-gustatory characteristic;

adhesively affixing the at least one smokable wrapping sheet around the finished pre-finished tobacco product to create a consumer-customized smoking product having olfacto-gustatory characteristics influenced by the at least one perceptible olfacto-gustatory characteristic of the at least one smokable wrapping sheet; and smoking the at least one smokable wrapping sheet by mouth together with the pre-finished tobacco product.

2. The method according to claim 1, which further comprises insulating the at least one wrapping sheet from the pre-finished tobacco product prior to use to prevent flavorants or scents from leaching out of the at least one wrapping sheet into the pre-finished tobacco product.

3. The method according to claim 1, which further comprises carrying out the step of creating a consumer-customized smoking product by rolling at least two wrapping sheets having similar olfacto-gustatory characteristics around the pre-finished tobacco product to achieve a desired strengthening effect for the olfacto-gustatory characteristics.

4. The method according to claim 1, which further comprises carrying out the step of creating a consumer-customized smoking product by rolling at least two wrapping sheets having different olfacto-gustatory characteristics around the pre-finished tobacco product to achieve a desired olfacto-gustatory effect.

5. The method according to claim 1, which further comprises providing a package and packaging the pre-finished tobacco product and the at least one wrapping sheet in the package.

6. The method according to claim 1, which further comprises selecting the at least one perceptible olfacto-gustatory characteristic as a material from the group consisting of natural and artificial flavorants, natural and artificial scents, spice extracts, flower extracts, fruit extracts, flavorants and scents of acacia, rose, cinnamon, jasmine, apple, martini, banana, berries, blackberry, blueberry, butterscotch, champagne, coffee, chocolate, cognac, cosmopolitan, gin and juice, grape, honey, Jamaica rum, kiwi, strawberry, magic stick, mango, mint, passion fruit, peach, pina colada, raspberry, sour apple, strawberry, strawberry margarita, sweet cherry, vanilla and watermelon, combinations of any two or more of the forgoing flavorants and scents, shocking aromas and scents and a mixture of coffee and chocolate scents.

7. The method according to claim 1, wherein the at least one smokable wrapping sheet is formed of tobacco.

8. The method according to claim 1, wherein the at least one smokable wrapping sheet is a plurality of smokable wrapping sheets being variable in number by the consumer to adjust a strength of the olfacto-gustatory characteristic.

9. A method for purveying a tobacco smoking product, the method comprising the following steps:

providing a smoking kit, the smoking kit including at least one pre-finished tobacco product, the pre-finished tobacco product being smokable by a person by mouth as is;

providing at least one wrapping sheet being smokable by a person by mouth and configured to be loosely wrapped around the pre-finished tobacco product in a predetermined shape with no adhesive between the at least one smokable wrapping sheet and the pre-finished tobacco product;

adhesively affixing the at least one smokable wrapping sheet around the finished pre-finished tobacco product to create a consumer-customized smoking product; and smoking the at least one smokable wrapping sheet by mouth together with the pre-finished tobacco product.

10. A method for preparing and smoking a tobacco smoking product, the method comprising the following steps:

providing at least one pre-finished tobacco product being smokable by a person by mouth as is;

providing at least one wrapping sheet being smokable by a person by mouth and configured to be loosely wrapped around the pre-finished tobacco product in a predetermined shape with no adhesive between the at least one smokable wrapping sheet and the pre-finished tobacco product, the at least one smokable wrapping sheet having at least one perceptible olfacto-gustatory characteristic;

adhesively affixing the at least one smokable wrapping sheet around the finished pre-finished tobacco product to create a consumer-customized smoking product having olfacto-gustatory characteristics influenced by the at least one perceptible olfacto-gustatory characteristic of the at least one smokable wrapping sheet; and smoking the at least one smokable wrapping sheet by mouth together with the pre-finished tobacco product.

11. A method for preparing and smoking a tobacco smoking product, the method comprising the following steps:

providing at least one pre-finished tobacco product being smokable by a person by mouth as is;

providing at least one wrapping sheet being smokable by a person by mouth and configured to be loosely wrapped around the pre-finished tobacco product in a predetermined shape with no adhesive between the at least one smokable wrapping sheet and the pre-finished tobacco product;

adhesively affixing the at least one smokable wrapping sheet around the finished pre-finished tobacco product to create a consumer-customized smoking product; and smoking the at least one smokable wrapping sheet by mouth together with the pre-finished tobacco product.

* * * * *